United States Patent [19]

Byrum

[11] Patent Number: 5,055,646

[45] Date of Patent: Oct. 8, 1991

[54] SLOW POSITIVE ACTION LOW AMPERAGE SWITCH

[76] Inventor: Barney L. Byrum, Box 18117, Baltimore, Md. 21220

[21] Appl. No.: 228,478

[22] Filed: Aug. 5, 1988

[51] Int. Cl.[5] ..... H01H 3/40

[52] U.S. Cl. ..... 200/507; 200/275; 200/60; 362/205; 362/206

[58] Field of Search ..... 200/500, 502, 507, 567, 200/570, 572, 504, 60, 238, 275, 51.14, 51.15, 51.16, 51.17; 362/157, 206, 205, 204; 439/661, 662, 663, 666, 339, 340

[56] References Cited

U.S. PATENT DOCUMENTS 2,170,317 8/1939 Bussmann ..... 200/507

4,515,237 5/1985 Gonzalez et al. ..... 200/507

*Primary Examiner*—Henry J. Recla

*Assistant Examiner*—Glenn T. Barrett

*Attorney, Agent, or Firm*—Epstein, Edell & Retzer

[57] ABSTRACT

A single pole, single throw switch for flashlights and other low amperage circuits is enclosed in a dielectric housing having an electric circuit contact fixed therein, the switch being selectively actuable by moving a threaded portion of a first electrode into and out of a complementarily threaded portion of a second electrode. Relative motion of the electrodes is achieved by manually rotating a cap-like part of the housing to which the first electrode is fixed. Voltages that can be accommodated by the switch are limited by the associated $I^2R$ effects of contact resistance during switch actuation. Various components of the switch are fixed in the dielectric housing by friction, tongue and groove fasteners, and screws to facilitate servicing and repair.

14 Claims, 1 Drawing Sheet

SLOW POSITIVE ACTION LOW AMPERAGE SWITCH

BACKGROUND OF THE INVENTION

Technical Field

Power switches are characterized by their capacity to transfer electric current across their electrodes. High amperage switches are high power switches designed to accommodate large $I^2R$ losses and which, even at low voltages, must open or close the circuit fast in order to prevent heat damage to their electrodes due to contact resistance.

The present invention is a low amperage switch. Its actuation is simple and reliable, being based on the rotation of a screw. This positive means of actuation, however, makes it inherently a slow opening and closing switch. Consequently, an appropriately descriptive acronym for the present invention is spalas which stands for slow positive action low amperage switch.

For electrical circuits, in general, switch unreliability and failure occur entirely too often. This basic weakness is made worse by the fact that switches, in general, do not lend themselves to servicing and repair. Furthermore, in many instances, the switch is made an integral part of a relatively expensive electrical device which is rendered practically worthless when the switch fails. In low voltage circuits, in particular, voltage drops due to contact resistance at switch electrodes and other junction points is a major cause of circuit malfunction. In spalas, these problems are greatly alleviated by the screw actuation of its electrodes together with its modular design and construction.

DESCRIPTION OF THE PREFERRED EMBODIMENTS

Figure 1:
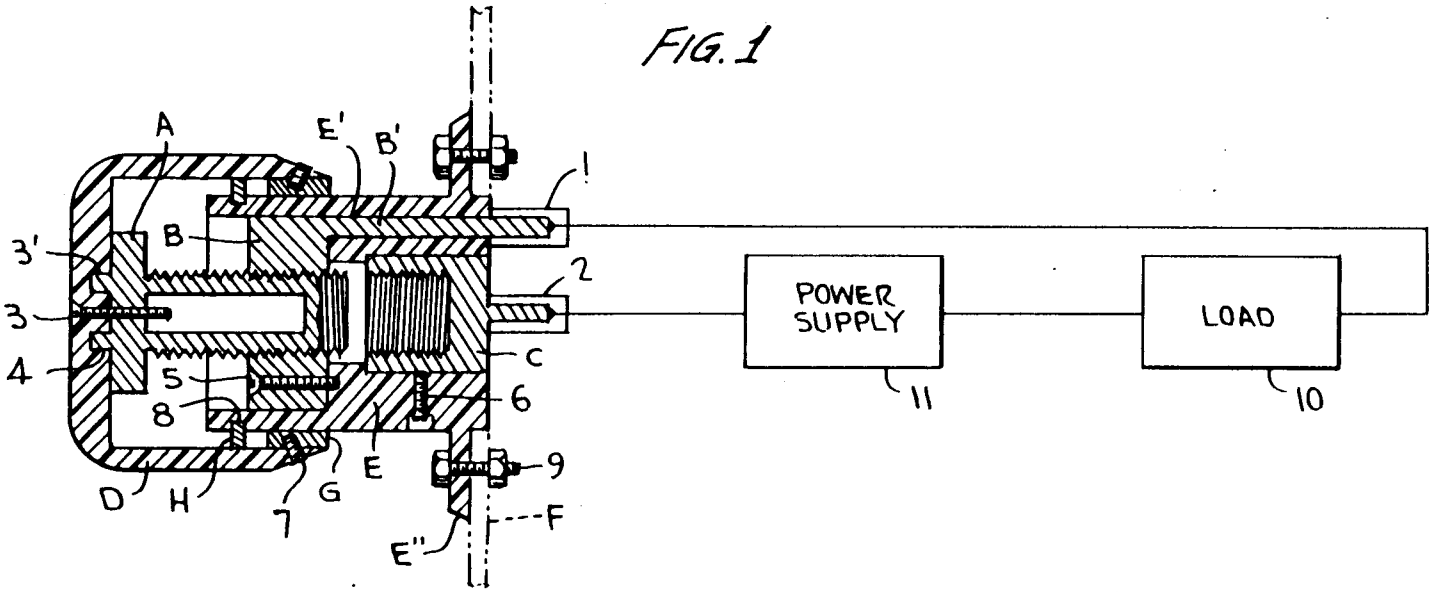
FIG. 1 is a cross-sectional drawing of spalas illustrating its basic simplicity and modular design.

This invention is a slow positive action low amperage switch (spalas) comprising a first electrode having members A & B and a second electrode C each electrode being enclosed in a dielectric material comprising housing top D and housing wall E, the geometry of A, B, C, D & E being, except for small deviations, that of a right circular cylinder, FIG. 1. With respect to housing wall E, member A of the first electrode is movable and member B is fixed, member A being an externally threaded screw which fits the internal threads of member B of the first electrode and those of the second electrode C. In FIG. 1, it is seen that member B of the first electrode deviates from circular cylinder geometry in that a portion B′ of it extends through a tunnel E′ in housing wall E to junction point 1. B′ may be a separate entity from B having junction point 1 and, in addition, a junction point in B. The second electrode C deviates from circular cylinder geometry in that a portion of it which extends from its closed end is junction point 2. Also, in this regard, portions of the cylindrical surfaces A, B, C, D, E & G may have straight line tongues or the corresponding grooves on them to fix specific pairs of them with respect to each other.

A collar comprising a portion E″ of housing wall E serves as means of attaching the switch to wall F of an arbitrary object, FIG. 1. Instead of the collar E″, threads on that portion of the exterior surface of housing wall E extending into wall F may be used for this purpose. Other means amenable to disassembly of the switch for repair may also be used.

Member A of the first electrode is attached to housing top D by means of friction, insulated screw 3, and circular groove 4, FIG. 1. One or more tongue and groove locks 3′ on portions of A & D common to the wall of groove 4 may be used to prevent rotation of A with respect to D, the tongue(s) 3′ being on A, e.g., FIG. 1. Member B of the first electrode is held in place against housing wall E by friction and one or more set screws 5. One or more tongue and groove locks 5′ on the corresponding portions of the outer wall of B and the inner wall of E may be used to prevent rotation of B with respect to E, the tongue(s) 5′ being on E, e.g., FIG. 1. The second electrode C is held in place against housing wall E by friction and one or more set screws 6. One or more tongue and groove locks 6′ on the corresponding portions of the outer wall of C and the inner wall of E may be used to prevent rotation of C with respect to E, the tongue(s) 6′ being on E, e.g., FIG. 1. Collar G the interior cylindrical surface of which fits the exterior cylindrical surface of housing wall E is held in place against the interior surface of housing top D by friction and two or more set screws 7 or by other means amenable to disassembly of the switch for repair. One or more tongue and groove locks 7′ on common portions of the inner wall of D and the outer wall of G may be used to prevent rotation of G with respect to D, the tongue(s) 7′ being on G, e.g., FIG. 1. An elastic ring H made discontinuous by a slot of suitable width fits into a circular groove 8 of housing wall E from which a portion of ring H protrudes sufficiently that together with the ring's elasticity its outer cylindrical surface expands until it touches the interior surface of housing top D. Two or more bolts 9 or other means amemable to disassembly of the switch for repair fasten the switch to wall F.

For a right-handed thread, as housing top D is rotated in a clockwise direction, member A of the first electrode advances toward the threaded portion of the second electrode C eventually entering and threadedly engaging electrode C to close the circuit between the load 10 and its power supply 11, FIG. 1. Member A of the first electrode can continue to penetrate the second electrode C until it is stopped by the exterior surface of its bottom contacting the interior surface of the bottom of the second electrode C.

For a right-handed thread, as housing top D is rotated in a counterclockwise direction, member A of the first electrode recedes from the threaded portion of the second electrode C eventually egressing from electrode C to open the circuit between the load 10 and its power supply 11. Member A of the first electrode can continue to recede from the second electrode C until a portion of the upper surface of collar G and a portion of the lower surface of ring H come into contact with each other, FIG. 1.

The housing wall E shown in FIG. 1 may also enclose the load 10 and its power supply 11. For example, in the spalas flashlight illustrated in FIG. 2, junction point 1 is located in a portion of conducting collar J held in place by friction and its shaping to fit a portion of interior housing wall E in conjunction with being screwed down by spalas flashlight top K against a portion of housing wall E extended to contain two batteries 11.1 & 11.2 in series with light bulb 10.1. The portion B' of member B of the first electrode may, for example, be a thin plate having right rectangular parallelopiped geometry. Upon exiting tunnel E' in housing wall E, plate B' extends along the interior of wall E to junction point 1 located in a portion of collar J.

Figure 2:
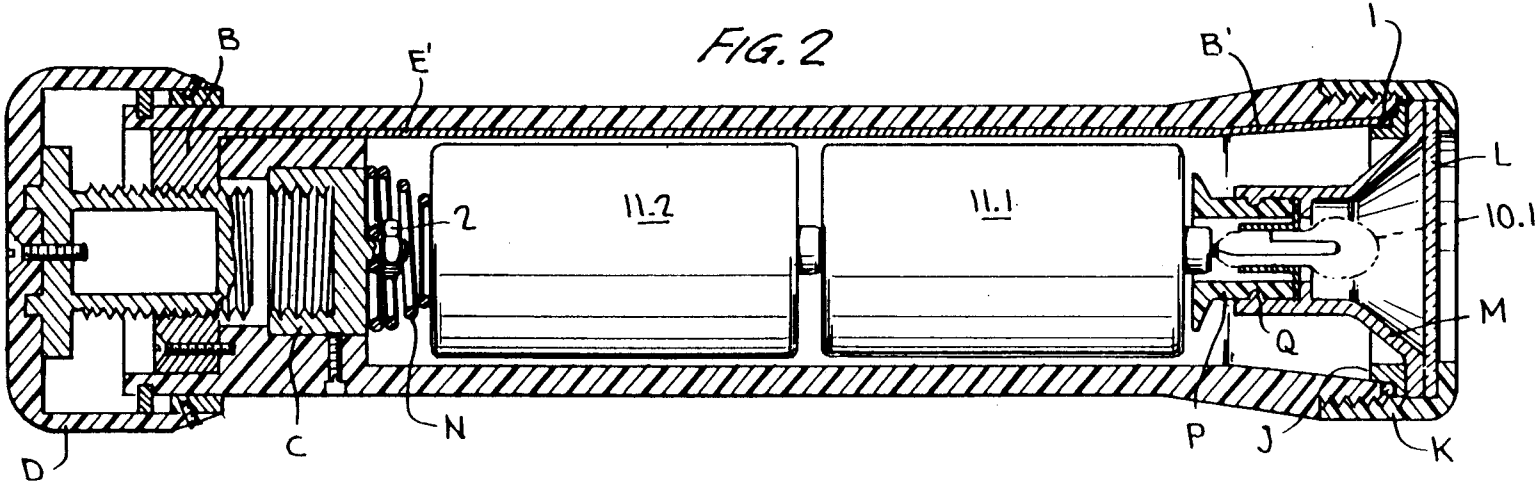
FIG. 2 is a cross-sectional drawing of a spalas flashlight.

With reference to FIG. 2, it is seen that when spalas flashlight top K is screwed down it can provide good electrical contact between illumination focusser M and coller J by holding window L against focusser M which in turn is held against collar J. Focusser M also assures that sufficient pressure is transmitted to coil spring N (serving as the electrical line connecting junction point 2 to the power supply) through the base of light bulb 10.1 and batteries 11.1 & 11.2, respectively, to provide good electrical contact at the junction points between: (a) the positive terminal of battery 11.1 and the base of light bulb 10.1; (b) the bottom of battery 11.1 and the positive terminal of battery 11.2; and (c) the coil spring N and the bottom of battery 11.2.

With reference to FIG. 1, it can be appreciated that spalas is designed to be repaired. Members B & C are pressed into housing wall E where they are fixed in place with tongue and groove locks 5' & 6', respectively, and one or more set screws 5 & 6, respectively, taking care to fit B' into and through tunnel E'. Member A is fitted into circular groove 4, where it is prevented from rotating with respect to housing top D by tongue and groove locks 3', and fastened to housing top D with screw 3. Ring H is fitted into groove 8 on housing wall E. Collar G can be separated from housing top D by removing set screws 7 and sliding G out of D along the tongue and groove lock(s) 7'. With collar G detached from housing top D and still encircling housing wall E, top D can be slid over ring H for removal or installation. With housing top D removed, ring H can be removed or installed. With ring H removed, collar G can be slid on or off housing wall E. Junction points 1 & 2 are plug-type or thread-type devices which connect spalas via appropriate electrical lines to load 10 and its power supply 11, respectively. Bolts 9, for example, fasten spalas to wall E, FIG. 1.

Similarly, with reference to FIG. 2, it can be seen that the spalas flashlight is designed to be repaired. Coil spring N is connected to electrode C by means of junction point 2, pressed into wall E, and fixed in place with tongue and groove lock(s) and set screw(s). Similarly, upon pressing member B into wall E, plate B' after exiting tunnel E' slides along the inside wall of E which may be appropriately grooved to secure B' in place after it is plugged into junction point 1, a portion of collar J. Collar J is shaped to fit closely against or partially within a portion of the inner surface of wall E and to be held securely in place there by suitable grooves and ridges in E, for example. Collar J must also be held closely against or partially within a portion of the thickness of E at its end to assure good electrical contact with a portion of focusser M that lies on top of the corresponding portion of collar J. This is accomplished by spalas flashlight top K which also holds window L in place. Battery 11.2 is slid into the container formed by wall E, then battery 11.1. Next, the base of light bulb 10.1 is inserted into the top of socket P and the pair pressed, glass bulb portion first, into the bottom of focusser M wherein they become fixed with respect to each other and with respect to focusser M by means of tongue and groove snap lock Q. Finally, window L is placed on top of focusser M and spalas flashlight top K is screwed on to fix window L, focusser M, light bulb 10.1, batteries 11.1 & 11.2, and spring N with respect to each other and with respect to wall E by transmitting suitable pressure through the base of light bulb 10.1, FIG. 2.

While I have described and illustrated various specific embodiments of my invention, it will be clear that variations from the details of construction which are specifically illustrated and described may be resorted to without departing from the true spirit and scope of the present invention as defined in the appended claims.

What is claimed is:

1. A single pole, single throw switch comprising:

a first electrode and a second electrode that serve to close a circuit between an arbitrary load and a power supply when the electrodes are brought into contact with each other;

said electrodes having substantially right circular, hollow cylindrical configurations and a common axis;

said electrodes being arranged in tandem along said common axis having adjacent ends separated when said circuit is open;

said first electrode having threads on a portion of a outer wall, said threads being complementary to threads on a portion of an inner wall of said second electrode;

said electrodes being installed in a dielectric container providing supporting structure, insulation and protective housing for said electrodes; said container including positional adjustment means, and said electrodes and said container being configured such that when said positional adjustment means is rotated said first electrode is rotated sufficiently about said common axis and approaches said second electrode and at least a portion of a threaded wall threadedly engages a corresponding portion of said second electrode thereby closing said circuit.

2. As recited in claim 1, said container and said electrodes comprising modular construction facilitating servicing and repair.

3. As recited in claim 1, said electrodes, power supply, and load being inside of said container.

4. As recited in claim 3, said container, electrodes, power supply, and load comprising modular construction facilitating servicing and repair.

5. As recited in claim 3, said power supply being at least one flashlight battery and said load being a filament of the corresponding flashlight bulb.

6. As recited in claim 5, said container, electrodes, power supply, and load comprising modular construction facilitating servicing and repair.

7. A single pole, single throw switch for selectively opening and closing a circuit containing a power supply and load, said switch comprising:

a first electrode having an externally threaded right circular electrically conductive cylindrical portion;

a second electrode having a hollow internally threaded right circular electrically conductive cylindrical portion configured to receive and threadedly engage the externally threaded first electrode;

a housing of dielectric material entirely enclosing said first and second electrodes;

mounting means for mounting said first and second electrodes inside said housing with said cylindrical portions of said first and second electrodes coaxially aligned; and positional adjustment means said housing for selectively rotating and longitudinally displacing said cylindrical portions of said first and second electrodes to selectively threadedly engage and disengage said cylindrical portions.

8. The switch according to claim 7 wherein said positional adjustment means comprises:

first and second dielectric parts of said housing joined together for mutual longitudinal displacement and selective rotation with respect to one another about an axis coaxially aligned with said cylindrical portions;

means securing said first electrode to said first housing part to permit rotation of said first electrode along with said first housing part;

means securing said said second electrode to said second housing part to permit rotation of said second electrode with said second housing part;

whereby mutual longitudinal displacement and rotation between said first and second housing parts effects threaded engagement and disengagement of said cylindrical portions.

9. The switch according to claim 8 wherein said positional adjustment means further comprises:

a support member fixedly secured in said housing to said second housing part and having an internally threaded cylindrical segment positioned coaxially with said cylindrical portions to engage the externally threaded cylindrical portion of said first electrode and thereby convert mutual rotation between said housing parts into longitudinal displacement between said housing parts.

10. The switch according to claim 9 wherein said support member is electrically conductive and includes a first electrical terminal for said switch, and wherein said second electrode includes a second electrical terminal for said switch.

11. The switch according to claim 10 wherein said power supply and said load are disposed within said housing.

12. The switch according to claim 11 wherein said power supply is a battery and said load is a lamp.

13. The switch according to claim 7 further comprising means connecting said switch in series with said power supply and said load to initiate current through the power supply, load and switch when said cylindrical portions of said first and second electrodes are brought into threaded engagement.

14. The switch according to claim 1 further comprising means connecting said switch in series with said power supply and said load to initiate current through said power supply, said switch and said load when the threaded walls of said first and second electrodes are brought into contact with one another.

* * * * *